US006733652B1

(12) United States Patent
Pütter et al.

(10) Patent No.: US 6,733,652 B1
(45) Date of Patent: May 11, 2004

(54) METHOD FOR ELECTROLYTICALLY CONVERTING ORGANIC COMPOUNDS

(75) Inventors: Hermann Pütter, Neustadt (DE); Guido Gutenberger, Bonn (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/070,450

(22) PCT Filed: Sep. 18, 2000

(86) PCT No.: PCT/EP00/09135

§ 371 (c)(1),
(2), (4) Date: Mar. 20, 2002

(87) PCT Pub. No.: WO01/21858

PCT Pub. Date: Mar. 29, 2001

(30) Foreign Application Priority Data

Sep. 20, 1999 (DE) ..... 199 44 990

(51) Int. Cl.[7] ..... C25B 3/00
(52) U.S. Cl. ..... 205/413; 205/427
(58) Field of Search ..... 205/413, 427

(56) References Cited

U.S. PATENT DOCUMENTS 4,318,783 A 3/1982 Buhmann ..... 204/59 R
4,544,450 A * 10/1985 Oberrauch et al. ..... 204/59 R

FOREIGN PATENT DOCUMENTS

DE 196 18 854 11/1997
DE 196 20 861 11/1997

OTHER PUBLICATIONS

Chernyshev et al., "Mechanism of the Electrochemical Synthesis of Ferrocene", Inst. of Phys. Org. Chem., Acad. of Sci. of the Belorussian SSR, Minsk. Trans. from Elektrokhimiya, vol. 18, No. 2, pp. 239–244, Feb., 1982, pp. 211–216.*

Cleghorn et al., "Investigations of the Electrocatalytic Hydrogenation of Organic Molecules at Palladium on Nickel Cathodes", Electrochimica Acta, vol. 38, No. 18, pp. 2683–2689, (month unavailable) 1993.*

I.S. Monakhova: "Synthesis and reactions of some methoxy derivatives of furan compounds" Chemical Abstracts, vol. 92, No. 20 May 19, 1980.

Gryorgy Horanyi et al.: "Electrochemical behavior of theylene glycol and its oxidation products at the platinum elec Electroreduction of oxo–containing bifunctional compounds with two carbon atoms in acidic media" Chemical Abstracts, vol. 89, No. 22 Nov. 07, 1978.

H. Lund et al., eds. "Methods for the elucidation of organic electrochemical reactions" Organic Electrochemistry, chapters 3 and 7–21, Marcel Dekker, New York, pp. 142 ff 1991.

Y. Chen et al.: "Electrooxidation of N–butanol to N–butyric acid using peroxide cathode and anode" J. Chin. Inst. Chem. Eng., vol. 27, No. 5, pp. 337–345 Sep. 96.

T. Iwasaki et al.: "Convenient syntheses of 4,4–dimethoxy esters and ketones" J. Org. Chem., vol. 47, pp. 3799–3802 1982.

A.P. Tomilov et al.: "Mechanism of the electrochemical synthesis of ferrocene" Elektrokhimiya, vol. 10, pp. 211–216 1982.

D. Sawyer et al. "Controlled–potential methods" Electrochemistry for Chemists, 2nd ed., pp. 68–78, John Wiley & Sons, Inc., New York 1995.

H. Lund et al., eds.: "Practical problems in electrolysis" Organic Electrochemistry, 3rd ed., chapter 6, Marcel Dekker, New York 1991.

H. Lund et al., eds.: "Electrolysis of heterocyclic Compounds" Organic Electrochemistry, chapter 18, Marcel Dekker, New York, pp. 701–763 1991.

* cited by examiner

*Primary Examiner*—Edna Wong
(74) *Attorney, Agent, or Firm*—Oblon, Spivak, McClelland, Maier & Neustadt, P.C.

(57) ABSTRACT

In a process for the electrolytic transformation of at least one organic compound in an electrolysis cell, the organic compound is both oxidized and reduced at one electrode.

13 Claims, No Drawings

METHOD FOR ELECTROLYTICALLY CONVERTING ORGANIC COMPOUNDS

The present invention relates to a process for the electrolytic transformation of organic compounds, in which one electrode simultaneously serves to transfer both oxidation and reduction equivalents.

An objective of preparative organic electrochemistry is to utilize the processes occurring in an electrochemical process at both electrodes in parallel.

An example of such a process is the oxidative dimerization of 2,6-dimethylphenol which is coupled with the dimerization of maleic esters (M. M. Baizer, in: H. Lund, M. M. Baizer (editors), Organic Electrochemistry, Marcel Dekker, New York, 1991, pages 142 ff.).

A further example is the coupled synthesis of phthalide and t-butylbenzaldehyde, as described in DE 196 18 854.

However, it is also possible to utilize the cathode process and the anode process to prepare a single product or to destroy one starting material. Examples of such electrochemical processes are the production of butyric acid (Y. Chen, T. Chou, J. Chin. Inst. Chem. Eng. 27 (1996) pages 337–345), the anodic dissolution of iron which is coupled with the cathodic formation of ferrocene (T. Iwasaki et al., J. Org. Chem. 47 (1982) pages 3799 ff.) or the decomposition of phenol (A. P. Tomilov et al., Elektrokhimiya 10 (1982) page 239).

A new opportunity opens up when oxidation and reduction take place at one and the same electrode. This means that a substrate receives both oxidation and reduction equivalents either simultaneously or successively.

A successive transfer of oxidation and reduction equivalents at one electrode is possible, for example, in cyclic voltametry in which the potential of the electrode switches between positive and negative values at a predetermined rate within a period of time (cf., for example, D. Sawyer, A. Sobkowiak, J. Roberts Jr., Electrochemistry for Chemists, Second Ed., pages 68–78, John Wiley & Sons, Inc. New York 1995).

In the context of the present invention, it has now been found that an anode is able to transfer reduction equivalents to a substrate which has already taken up anodic redox equivalents.

The process is not restricted to the anode, but can likewise be carried out at the cathode under suitable conditions.

It is an object of the present invention to provide an electrochemical process in which an organic compound is oxidized in one electrode process and the oxidation product is reduced at the same electrode.

We have found that this object is achieved by the process of the present invention for the electrolytic transformation of at least one organic compound in an electrolysis cell, wherein the organic compound is both oxidized and reduced at one electrode.

In a preferred embodiment of the invention, the process of the present invention occurs in an undivided cell.

In a further preferred embodiment of the invention, the organic compound is both oxidized and reduced, preferably hydrogenated, at the anode.

In one preferred embodiment of the invention, the organic compound is hydrogenated by means of hydrogen at the one electrode, with hydrogen being formed as product at the other electrode or being supplied from outside to the electrolysis circuit.

In another preferred embodiment of the invention, the organic compound is both reduced and oxidized, preferably oxygenated, at the cathode. In the following, the invention will be illustrated by the example of anodes which simultaneously oxidize and hydrogenate.

Organic compounds which can be used as starting materials in the process of the present invention are in principle all organic compounds which have reducible groups, preferably a furan or a substituted furan.

The process is not restricted to furan or substituted furans, but extends to all compounds and classes of compounds which are oxidizable or reducible or both by methods of organic electrochemistry. An overview of the classes of compounds is given by H. Lund, M. M. Baizer, (editors) "Organic Electrochemistry", 3rd edition, Marcel Dekker, New York 1991.

Suitable compounds of the stated classes are, for example, compounds containing double bonds, e.g.

1) Olefins

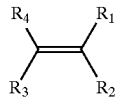

where $R_1$ to $R_4$ are each an alkyl, aryl or alkoxy group, a hydrogen atom, a (substituted) amino group, a halogen atom or a cyano group and the substituents $R_1$ to $R_4$ may be identical or different.

The double bonds can be part of open-chain or cyclic compounds, and can be part of the ring or of the chain or of both.

For the purposes of the present invention, cyclic systems containing double bonds can be, in particular, aromatic systems.

In the compounds having a cyclic structure, one or more element(s) of the cyclic structure can be an unsubstituted or substituted heteroatom such as N, S, O, P.

The cyclic compounds may bear one or more functional substituents of the following types:

carboxyl groups, carbonyl groups (and N analogues), carboxymethyl groups, nitrile groups, isonitrile groups, azo (azoxy) groups, nitro groups, amino groups, substituted amino groups, halogens.

2) Alkynes

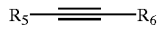

where $R_5$ and $R_6$ are each a hydrogen atom or an aryl, alkyl, carboxyl or alkoxycarbonyl group, and the substituents $R_5$ and $R_6$ may be identical or different.

3) Carbonyl Compounds $$R_7—CO—R_8$$

where $R_7$ and $R_8$ are each an aryl, alkyl, alkoxy or aryloxy group or a substituted amino group or a halogen atom, and the substituents $R_7$ and $R_8$ may be identical or different.

In a preferred embodiment of the process of the present invention, furan is used. Apart from furan, substituted furans such as the following compounds are also preferred:

furfural (furan 2-aldehyde), alkyl-substituted furans, furans bearing —CHO, —COOH, —COOR groups, where R is an alkyl, benzyl, aryl or, in particular, a $C_1$–$C_4$ alkyl group, —$CH(OR_1)(OR_2)$ groups, where $R_1$ and $R_2$ may be identical or different and $R_1$ and $R_2$ are each an alkyl, benzyl, aryl or, in particular, $C_1$–$C_4$-alkyl group, and —CN groups in the 2, 3, 4 or 5 positions.

In the reaction of organic compounds according to the present invention, it is possible to use solvents and electrolyte salts as are described in H. Lund, M. M. Baizer, (editors) "Organic Electrochemistry", 3rd edition, Marcel Dekker, New York 1991.

According to the present invention, the oxidation of furans is preferably carried out in the presence of methanol or in the presence of ethanol or a mixture thereof, but more preferably in the presence of methanol. These substrates can simultaneously be a reactant and solvent.

As solvents in the reaction of furans, it is generally possible to use all suitable alcohols in addition to the organic compound and the compound used for oxidation.

As electrolyte salts in the reaction of furans in the process of the present invention, it is possible to use not only NaBr but also, for example, alkali metal halides and/or alkaline earth metal halides, with bromides, chlorides and iodides being conceivable as halides. Ammonium halides can likewise be used.

Pressure and temperature can be matched to the conditions which are customary in catalytic hydrogenations.

In a preferred embodiment of the process of the present invention, the reaction temperature T is <50° C., preferably <25° C., the pressure p is <3 bar and the pH is in the neutral region.

In a preferred embodiment of the process of the present invention, intermediates are introduced in addition to the starting materials which are introduced into the preferably undivided electrolysis cell. The term intermediate refers to the product or products which is/are obtained by the electrolytic oxidation according to the present invention of the organic compound or compounds, in particular a furan or a substituted furan or a mixture of two or more thereof, and is therefore present in the electrolysis circuit. The concentration of additional intermediates is set by means of customary electrochemical and electrocatalytic parameters, for example current density and type and amount of catalyst, or the intermediate is added to the circuit.

In respect of the specific choice of the material of the electrodes, there is no restriction in the process of the present invention, as long as the electrodes are suitable for the process as described above.

Preference is given to using graphite anodes in the electrolysis cell.

As regards the geometry of the electrodes in the electrolysis cell, there are essentially no restrictions in the context of the present invention. Examples of preferred geometries are plane-parallel electrode arrangements and annular electrode arrangements.

In a preferred embodiment of the invention, the anode is in contact with at least one hydrogenation catalyst. In a particularly preferred embodiment, the hydrogenation catalyst or catalysts is/are part of a gas diffusion electrode. In a further preferred embodiment of the invention, the anode is a graphite electrode coated with a noble metal in the form of plates, meshes of felts. In another preferred embodiment of the invention, the hydrogenation catalyst is in the form of a suspension in the electrolyte and is continually brought into contact with the anode. Here, the hydrogenation catalyst, i.e. the catalytically active material, is pumped around the cell or is deposited on an appropriately structured anode from suspension. An electrode of the latter type is described, for example, in DE 196 20 861.

In the process of the present invention, an organic compound is reduced, preferably hydrogenated, at the anode by means of the hydrogen which is formed as product in the cathode process. This hydrogenation preferably takes place by the compound to be hydrogenated being brought into contact with one or more hydrogenation catalysts which are in turn brought into contact with the anode.

As regards the choice of hydrogenation-active catalysts, there are in principle no restrictions for the purposes of the process of the present invention. All catalysts known from the prior art can be used. Examples which may be mentioned are the metals of transition groups I, II and VIII of the Periodic Table, in particular Co, Ni, Fe, Ru, Rh, Re, Pd, Pt, Os, Ir, Ag, Cu, Zn and Cd.

According to the present invention, it is possible, for example, to use the metals in finely divided form. Examples are Raney Ni, Raney Co, Raney Ag and Raney Fe, which may further comprise other elements such as Mo, Cr, Au, Mn, Hg, Sn as well as S, Se, Te, Ge, Ga, P, Pb, As, Bi or Sb.

It is naturally also possible for the hydrogenation active materials described to comprise a mixture of two or more of the specified hydrogenation metals, which may be contaminated by, for example, one or more of the abovementioned elements.

Of course, it is also conceivable for the hydrogenation-active material to be applied to an inert support. As such support systems, it is possible to use, for example, activated carbon, graphite, carbon black, silicon carbide, aluminum oxide, silicon dioxide, titanium dioxide, zirconium dioxide, magnesium dioxide, zinc oxide or mixtures of two or more thereof, e.g. as a suspension or as fine granules.

In a preferred embodiment of the present invention, the hydrogenation-active material is applied to a base material for gas diffusion electrodes.

The present invention accordingly also provides a process as described above in which the base material for gas diffusion electrodes is laden with a hydrogenation-active material.

Possible hydrogenation-active materials with which the gas diffusion electrode system is laden are all the above-described hydrogenation catalysts. Of course, it is also possible to use a mixture of two or more of these hydrogenation catalysts as hydrogenation-active material.

For the purposes of the process of the present invention, it is naturally also conceivable for the gas diffusion electrode material to be laden with hydrogenation-active material and for use to be made of additional hydrogenation-active material which is identical to or different from that with which the gas diffusion electrode material is laden.

Furthermore, the present invention provides, in general form, for the use of a gas diffusion electrode for the electrolytic transformation of an organic compound, preferably an unsaturated organic compound, in an electrolysis cell.

The following examples illustrate the present invention.

EXAMPLE 1

An undivided cell having 6 annular electrodes having a surface area per side of 15.7 $cm^2$ was used. The electrodes were separated from one another by 5 spacer meshes having a thickness of 0.7 mm.

The electrodes comprised graphite plates each having a thickness of 5 mm and having one side coated with gas diffusion electrode material. This material was in turn laden with 5.2 g of $Pd/m^2$.

The gas diffusion electrode was made the cathode. The electrolyte mixture consisted of 30 g of furan, 57.4 g of 2,5-dimethoxydihydrofuran, 2 g of NaBr and 110.6 g of methanol.

The electrolysis was carried out at 0.5 A and a temperature of about 17° C. The cell voltage rose from 14.6 V to 20.7 V. The electrolysis was followed by gas chromatography.

After 1 F/mol of furan, the GC-percent by area of furan had been reduced from 22.7% to 17.8%, while the proportion of dimethoxydihydrofuran remained constant at 31 percent by area. At the same time, 0.9% of 2,5-dimethoxytetrahydrofuran was formed.

This example shows that the cathode is capable of catalytic hydrogenation. When graphite plates alone are used, i.e. not in the presence of a hydrogenation catalyst, good yields of 2,5-dimethoxydihydrofuran are obtained in agreement with the literature (H. Lund, M. M. Baizer, Organic Electrochemistry, Marcel Dekker, New York, 1991, page 720); 2,5-dimethoxytetrahydrofuran is not disclosed and was not found.

EXAMPLE 2

Example 2 was carried out using the arrangement from Example 1, but here the anode was provided with electrocatalytically active material. Instead of a gas diffusion cathode, a gas diffusion electrode laden with 5.2 g of $Pd/m^2$ was used as anode.

The electrolyte mixture consisted of 30 g of furan, 57.4 g of 2,5-dimethoxydihydrofuran, 2 g of NaBr and 110.6 g of methanol.

The electrolysis was carried out at 0.5 A and a temperature of 17° C. The cell voltage rose from 16.3 V to 19.5 V. The electrolysis was followed by gas chromatography.

After 1 F/mol of furan, the GC-percentage by area of furan had been reduced from 22.7 to 16.9%, and the GC-percentage by area of 2,5-dimethoxydihydrofuran remained at 30%. At the same time, 3.3% of 2,5-dimethoxytetrahydrofuran were formed.

The comparison shows that the anode operates even more effectively than the cathode. This arrangement is thus not purely dependent on the presence of catalytically active material in the cells.

We claim:

1. A process for the electrolytic transformation of at least one organic compound in an electrolysis cell, comprising the steps of:

oxidizing the organic compound at one electrode of the electrolysis cell having a given polarity to provide an oxidized species, and reducing the oxidized species at the same electrode of the electrolysis cell having the same given polarity.

2. The process as claimed in claim 1, wherein the oxidized species are reduced by hydrogenation.

3. The process as claimed in claim 1, wherein the anode is in contact with at least one hydrogenation catalyst.

4. The process as claimed in claim 3, wherein the hydrogenation catalyst is a noble metal.

5. The process as claimed in claim 3, wherein the hydrogenation catalyst is applied to a graphite felt anode.

6. The process as claimed in claim 3, wherein the hydrogenation catalyst is deposited on the anode from suspension.

7. The process as claimed in claim 3, wherein the hydrogenation catalyst in the form of a suspension is brought into contact with the anode.

8. The process as claimed in claim 1, wherein the electrode is a gas diffusion electrode.

9. The process as claimed in claim 1, wherein the organic compound is furan or a furan derivative or furan and a furan derivative.

10. A process for the electrolytic transformation of at least one organic compound in an electrolysis cell, comprising the steps of:

reducing the organic compound at one electrode of the electrolysis cell having a given polarity to provide a reduced species, and oxidizing the reduced species at the same electrode of the electrolysis cell having the same given polarity.

11. The process as claimed in claim 10, wherein the electrode is the cathode.

12. The process as claimed in claim 10, wherein the electrode is a gas diffusion electrode.

13. The process as claimed in claim 10, wherein the organic compound is furan or a furan derivative or furan and a furan derivative.

* * * * *